United States Patent [19]

Giacomazzi et al.

[11] Patent Number: 4,989,572

[45] Date of Patent: Feb. 5, 1991

[54] VEHICLE FUEL SYSTEM WITH REDUCED TANK HEATING

[75] Inventors: Roy A. Giacomazzi, Rochester Hills; S. Raghuma Reddy, West Bloomfield; Gregory E. Rich, Richmond, all of Mich.

[73] Assignee: General Motors Corportion, Detroit, Mich.

[21] Appl. No.: 481,087

[22] Filed: Feb. 16, 1990

[51] Int. Cl.[5] ..... F02M 37/04

[52] U.S. Cl. ..... 123/514; 123/510; 123/509; 220/500; 137/264; 137/576; 137/571

[58] Field of Search ..... 123/514, 508, 557, 516, 123/510; 137/264, 571, 574, 576; 220/20, 20.5, 22, 855

[56] References Cited

U.S. PATENT DOCUMENTS

| | | | |
|---|---|---|---|
| 2,953,156 | 9/1960 | Bryant | 137/264 |
| 2,998,056 | 8/1961 | Catehart | 137/571 |
| 3,792,273 | 4/1973 | Shimroy | 417/79 |
| 4,077,884 | 3/1978 | Naumann | 210/172 |
| 4,175,527 | 11/1979 | Sanada et al. | 123/136 |
| 4,354,521 | 10/1982 | Hardy | 137/571 |
| 4,672,937 | 6/1987 | Fales | 123/509 |
| 4,747,388 | 5/1988 | Tuckey | 123/514 |
| 4,750,522 | 6/1988 | Griffin | 123/514 |
| 4,831,990 | 5/1981 | Tuckey | 123/514 |
| 4,850,327 | 7/1989 | Fayard | 123/557 |
| 4,860,714 | 8/1989 | Bucci | 123/514 |
| 4,869,225 | 9/1989 | Nagata | 123/509 |
| 4,878,518 | 11/1989 | Tuckey | 123/510 |
| 4,928,657 | 5/1990 | Asselin | 123/514 |

*Primary Examiner*—Carl Stuart Miller

*Attorney, Agent, or Firm*—Patrick M. Griffin

[57] ABSTRACT

Warmed returned fuel from a vehicle fuel injection system is returned only a segregating canister in the tank, and pumped back therefrom preferentially, with make up fuel allowed in only as needed. Overall heating of the stored fuel, and consequent running losses, are substantially reduced, with no ill effects on vehicle operation.

2 Claims, 3 Drawing Sheets

VEHICLE FUEL SYSTEM WITH REDUCED TANK HEATING

This invention relates to vehicle fuel systems in general, and specifically to such a system with a novel means for reducing the heating of stored tank fuel by the warmer fuel returned to the tank.

BACKGROUND OF THE INVENTION

The control of ordinary fuel vapor emissions from vehicle fuel tanks is handled adequately by conventional vapor storage and retrieval systems. No particular effort is made to reduce the level of vaporization that normally occurs within the tank. However, the prospect of more strict regulations requiring that the vapors displaced from a tank when it is filled also be recovered has raised concerns about the adequacy of storage canister capacity. Consequently, there has been increased interest in finding ways to reduce the level of fuel vaporization within the tank in the first instance. One of the primary causes of increased fuel vaporization is fuel heating.

Fuel heating and vaporization may occur just from hot outside temperatures as the vehicle sits, generally referred to as diurnal losses. Another cause of fuel heating, especially in vehicles with fuel injection systems, is the return of unburned fuel to the tank. More fuel is pumped through the fuel rails than is burned, and is inevitably warmed somewhat. Warmer returned fuel, when mixed with the stored fuel, raises the overall fuel temperature The more thorough the mixing, the more thorough the heating and the greater the consequent fuel vaporization, generally called running losses Many vehicle fu®l systems place the pump inside the tank, with the pump inlet near the bottom of the tank. In order to assure a constant supply of fuel at the pump inlet to avoid pump starvation during cornering, a reservoir may be built around the pump. Some systems go farther than that, and use the force of the returned fuel stream to power a venturi nozzle and force more stored fuel toward the pump inlet. More fuel may be forced toward the pump than the pump needs, causing the reservoir to overflow. This enhances the mixing of returned and stored fuels, increasing the heating effect and consequent running losses.

SUMMARY OF THE INVENTION

The invention provides a vehicle fuel supply system in which the heating of the stored fuel is substantially reduced. In the embodiment disclosed, a canister type enclosure inside the tank contains the pump, so that the pump draws fuel directly from within the canister. The fuel return line also dumps fuel back into the canister, so the pump will re send returned fuel preferentially, unless make-up fuel is needed. There is an inlet to the canister for make up fuel, but it is designed to work in one direction only, comprising a freely pivoted flapper door. Make up fuel can freely enter as needed, but returned fuel is substantially blocked from mixing with the stored fuel. This deliberate and substantially complete segregation of the returned fuel from the stored fuel greatly reduces the heating effect. The insulating effect of the canister further reduces heat transfer. As a consequence, running losses are reduced significantly.

It is, therefore, an object of the invention to reduce running losses in a vehicle fuel system by reducing the heating effect of returned fuel on fuel stored in the vehicle fuel tank.

It is another object of the invention to reduce the heating effect by substantially segregating the returned fuel from the stored fuel, and by drawing preferentially from returned fuel in the canister, with make up fuel allowed into the canister only as needed.

It is another object of the invention to segregate the returned fuel from the stored fuel by the use of a one-way make up fuel inlet to the canister, thereby substantially reducing the mixing of reduced and stored fuel, and its heating effect.

DESCRIPTION OF THE PREFERRED EMBODIMENT

These and other objects and features of the invention will appear from the following written description, and from the drawings, in which.

Figure 1:
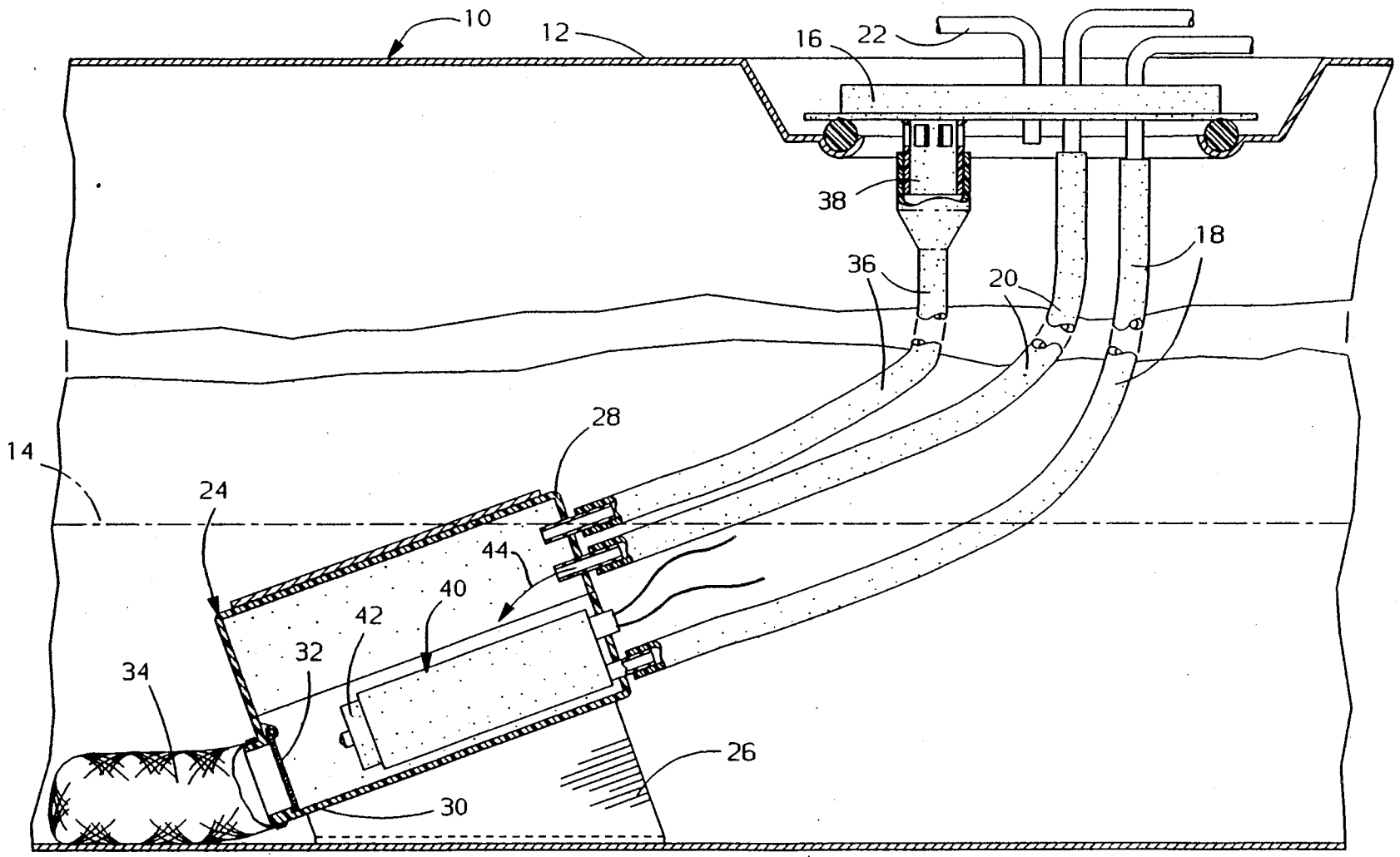
FIG. 1 is a view of a portion of a vehicle fuel system storage tank broken away to show the top and bottom of the tank, and with the canister shown in cross section.

Referring first to FIG. 1, a vehicle fuel system, designated generally at 10, includes a conventional fuel storage tank, generally designated at 12. Fuel in tank 12 may be conveniently referred to as stored fuel, indicated at 14. Tank 12 has an apertured top wall closed by a sealed flange 16. Flange 16 mounts several lines, including a fuel sending line 18, a fuel return line 20, and a tank vapor vent line 22. Fuel travels in the sending line 18 to a fuel injection system, not illustrated, and the unburned portion of it returns in a heated condition, through return line 20, to tank 12. Fuel vapors formed in tank 12, when they reach a certain pressure, are vented through tank vapor vent line 22 to a conventional storage device, also not illustrated. In a conventional system, the returned fuel from line 20 would be fed directly back into the stored fuel 14. The mixing with, and consequent heating, of the stored fuel 14 would contribute to elevated running losses. This mixing is substantially eliminated by the invention, described next.

Referring still to FIG. 1, the invention includes a containment enclosure which, in the preferred embodiment, is a cylindrical canister, designated generally at 24. Canister 24 is formed of a suitable fuel resistant plastic, of which there are several possibilities. As such, canister 24 would also be less conductive than ordinary metals. Canister 24 is mounted by a flange 26 to the inner bottom wall of tank 12 at about a 45 degree angle. This orients the canister 24 so as to have what may be termed an upper and lower corner 28 and 30, with lower corner 30 quite close to the bottom wall of tank 12. A one-way flapper door 32 is pivoted to the inside of the bottom end wall of canister 24 so as to provide an inlet from the interior of tank 12 through lower corner 30. The pivot for door 32 is made as friction free as possible, so that it can swing freely inwardly, but not outwardly. A filter sock 34 is attached over flapper door 32. At the upper corner 28, a vent line 36 enters canister 24. Vent line 36 is mounted at the top to a slotted sleeve 38 on flange 16, well above the highest level the stored fuel 14 could attain. A conventional fuel pump, designated generally at 40, is mounted inside canister 24 so as to put its intake, 42, near the bottom. Intake 42 is spaced away from flapper door 32 far enough to allow it to swing clearly, but since canister 24 is slanted, that does not put intake 42 at too high a location within the interior of tank 12. Pump 40 would be operated by conventional circuitry, not shown.

Figure 2:
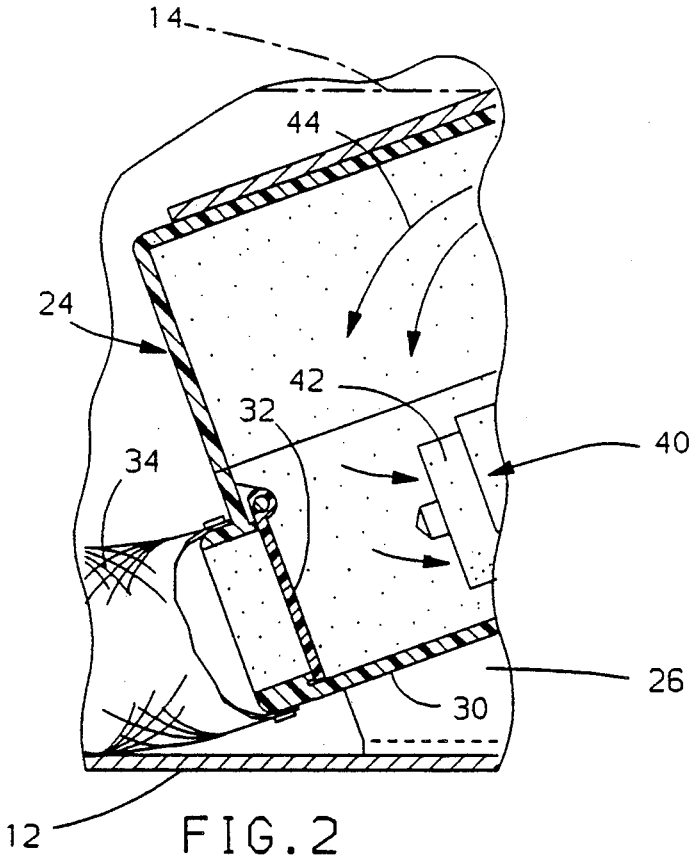
FIG. 2 is an enlarged view of the end of the canister, with the make up fuel inlet closed.
Figure 3:
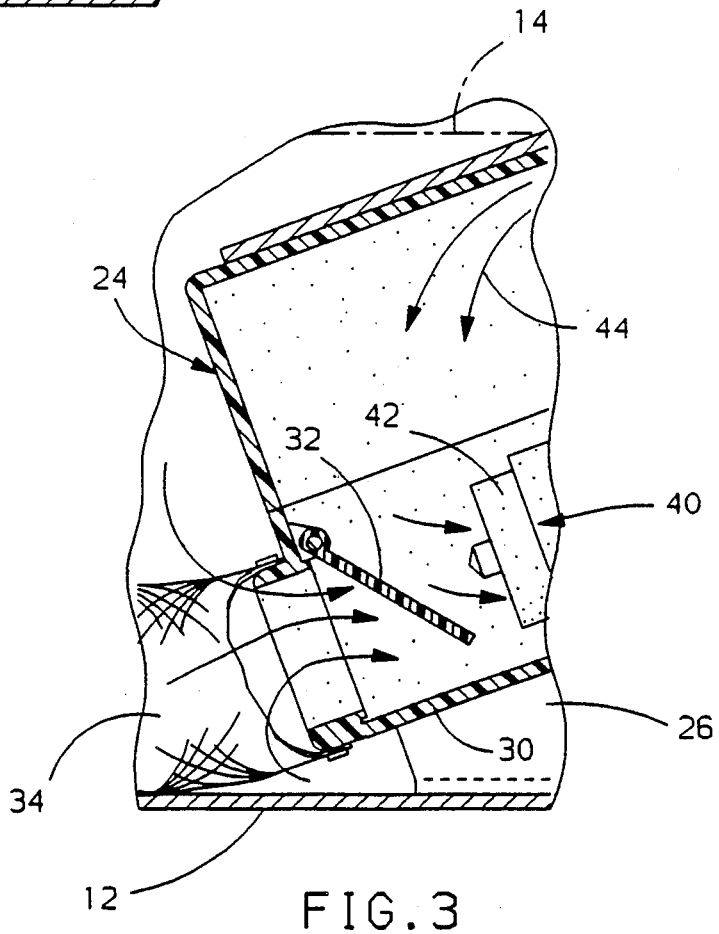
FIG. 3 is a view like FIG. 2, but with the inlet open.

Referring next to FIGS. 2 and 3, when tank 12 is first filled, fuel will enter canister 24 freely through flapper door 32, assuming that canister 24 is not already filled. The vent line 36 would allow any air in canister 24 to be freely displaced. So, before the vehicle is started, tank 12 will be filled with stored fuel 14, and canister 24 will be filled as well. As the vehicle is started, pump 40 begins to draw fuel from within canister 24, as shown by the arrows entering intake 42. The fuel drawn by pump 40 is sent to the fuel injection system through sending line 18. A substantial portion of the fuel pumped out is not burned, and is returned through return line 20 to canister 24, and is separately indicated at 44. The returned fuel 44 cannot escape past flapper door 32, and has no exit from canister 24 except back through pump intake 42. Pump 40 will pump already returned fuel 44 back again, unless conditions are such that some stored fuel 14 does enter canister 24. This occurs when the pressure inside canister 24 falls below that in the surrounding interior of tank 12, as shown in FIG. 3, opening flapper door 32 inwardly. This pressure differential will occur when canister 24 has been significantly emptied, but before intake 42 has become starved of fuel. Returned fuel 44 will still be entering canister 24, as well. When the pressure equalizes again, flapper door 32 swings shut again quickly. Door 32 is the key to preventing any significant mixing of return fuel 44 with stored fuel 14 as make up fuel enters.

Figure 5:
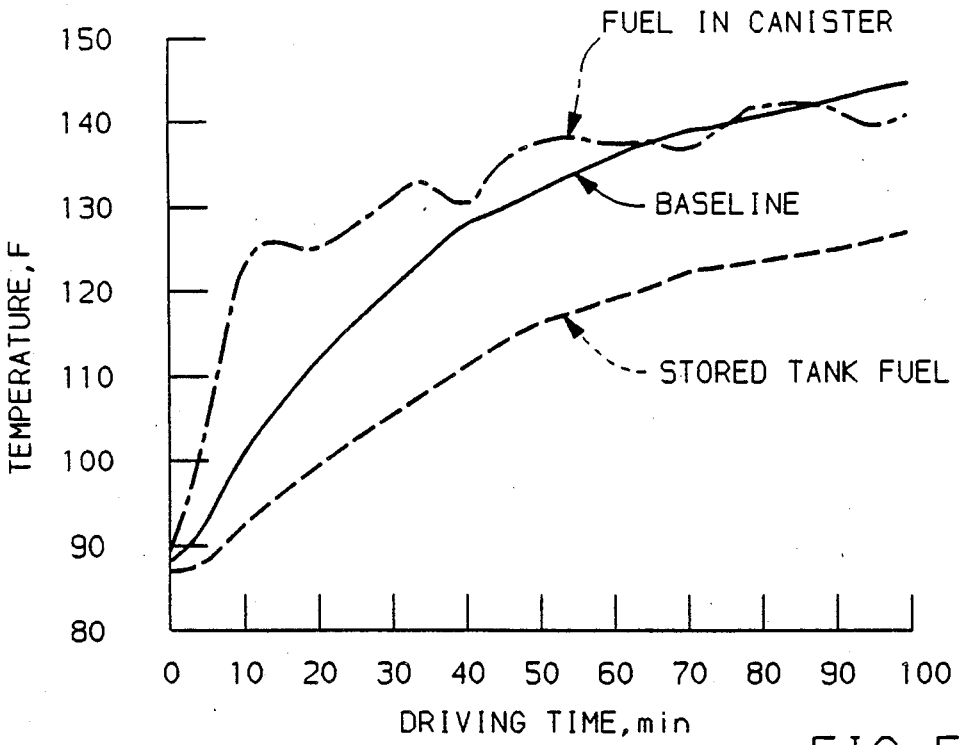
FIG. 5 is a graph showing the temperatures of the fuel in the tank and the canister as compared to a conventional system.

Referring next to FIG. 5, the effects on fuel temperatures are illustrated, and compared to the conventional case. Though the operation is simple, the temperature effects are significant, and rather unexpected. Since returned fuel 44 is deliberately physically segregated from the stored fuel 14, the pump 40 may be said to preferentially pump returned fuel 44. That is, at any point during operation, a good portion of the fuel pumped from canister 24 will be heated fuel that has already made one or more trips. No attempt was made to cool the fuel inside canister 24. It was previously thought that unless the fuel sent to the injectors were kept cool, it would overheat. In a conventional system, directly mixing returned fuel with the bulk of the tank fuel assured that none of the fuel got too hot. But, it also assured an inevitable and even heating of all of the fuel in the tank with time. This conventional heating effect is shown by the solid line in FIG. 5, and is called the base line temperature. In the invention, the fuel inside canister 24 initially gets significantly hotter than the baseline temperature, because of its segregation, but that segregation also keeps the temperature of the stored fuel 14 significantly cooler than the base line temperature. Furthermore, with time, the temperature of the fuel in canister 24 came down to the baseline temperature, sometimes running even lower. This is surprising. It may be, since the rate of heat transfer from the engine to the pumped fuel is proportional to the temperature differential, and since the pumped fuel comes preferentially from the warmer fuel confined in canister 24, that there is less heat energy transferred to the fuel in the fuel rails. Then, with time, the make up fuel that does enter canister 24 is cooler than normal. Both causes could potentially contribute to this result.

Figure 4:
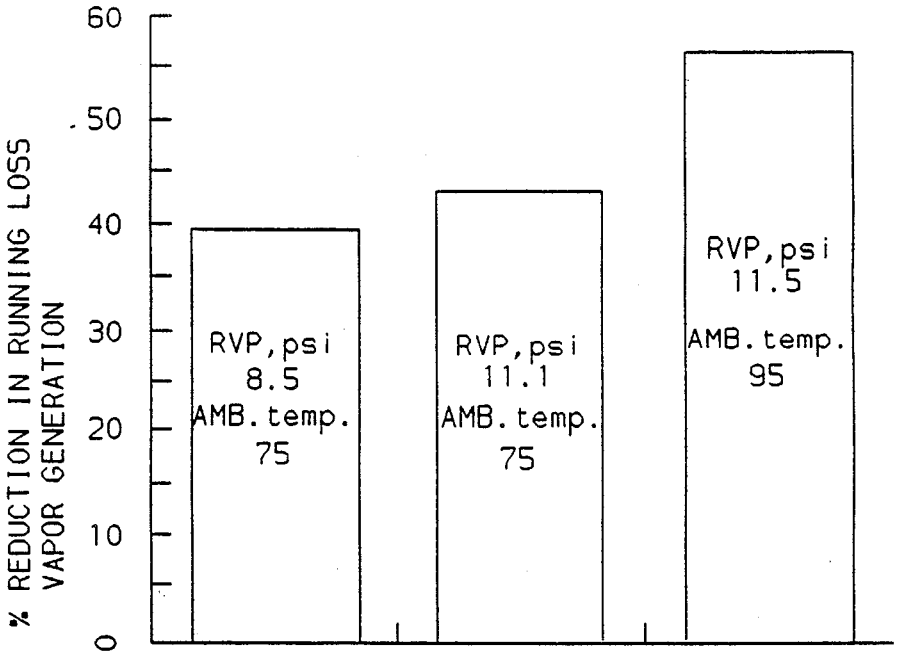
FIG. 4 is a graph showing the percentage of running loss reduction achieved in tests of the invention under various conditions.

Referring next to FIG. 4, the effect on running losses is illustrated for different fuels with differing Reid Vapor Pressure, and at differing ambient temperatures. Since the stored fuel 14 represents the great bulk of the fuel in tank 12, it also produces the majority of the running losses. Since the stored fuel 14 stayed cooler, running losses were much lower than normal, better than 50% lower in one case. This decrease in running losses, was achieved at essentially no extra cost, as compared to conventional fuel pump systems, and no ill effects on engine operation were detected. Vapor lock did not occur, despite the initially higher temperature of the fuel inside canister 24. Furthermore, canister 24 also provides the same prevention of fuel pump starvation during cornering that any reservoir surrounding the pump would.

Despite the fact that not all the results are as yet fully understood, it is thought that some variations of the embodiment disclosed could be made. It is likely that the most important factor in reducing fuel heating is the physical segregation of the heated returned fuel, rather than the insulating effect of the canister material. Therefore, a metal canister would likely produce much of the same benefit. Nevertheless, the non-conductive nature of plastic surely helps to reduce heat transfer, and there are a number of plastics that are sufficiently fuel resistant. Other one-way make up fuel inlets could be devised, so long as they provided an essentially complete physical barrier to egress from the canister, but opened quickly in response to the pressure differential described. Just a filter material or the like over the inlet would not be suitable for such a selective and fast acting one-way barrier. The slanted orientation of canister 24 is thought to be significant. This brings a lower corner 30 close to the bottom of tank 12, but does not block easy access of the make up fuel stream to door 32, and also creates the upper corner 28 for easy venting of the canister 24. Furthermore, it is likely that the orientation of the flapper door 32 at the bottom of canister 24 helps it shut quickly, as returned fuel 44 attempts to run out. Nevertheless, a different containment enclosure could likely be used. An open topped canister that was tall enough to prevent any spill over of returned fuel 44, and which had a sufficiently fast acting one-way inlet, should provide the same basic benefit. The fuel pump 40 could be placed elsewhere, so long as it drew from the canister 24, but it is convenient to put it inside canister 24, thereby allowing the whole subassembly to be withdrawn when flange 16 is removed. Therefore, it will be understood that the invention is not intended to be limited to just the embodiment disclosed.

The embodiments of the invention in which an exclusive property or privilege is claimed are defined as follows:

1. In a vehicle fuel system having a tank with a supply of stored liquid fuel, and in which at least some fuel is returned to the tank in a heated condition, a means for reducing the heating of said stored fuel caused by said returned fuel, comprising, a containment enclosure located in the interior of said tank, a fuel return line to said containment enclosure that sends said returned fuel only to said containment enclosure, a fuel pump arranged so as to draw fuel only from inside said enclosure, and a one-way make up fuel inlet to said containment enclosure to allow stored fuel into said enclosure from said tank, but to substantially prevent the back flow of returned fuel to said tank from said enclosure, said inlet comprising the only communication between said enclosure and said stored fuel, whereby, returned fuel is segregated from said stored fuel and is pumped preferentially from said enclosure, with make up fuel entering said inlet only as needed, thereby substantially reducing the heating effect of said returned fuel on said stored fuel.

2. In a vehicle fuel system having a tank with a supply of stored liquid fuel, and in which at least some fuel is returned to the tank in a heated condition, a means for reducing the heating of said stored fuel caused by said returned fuel, comprising, a containment canister mounted in the interior of said tank, a fuel return line to said canister that sends said returned fuel only to said canister, a fuel pump located inside said canister so as to draw fuel only from inside said canister, and a flapper door pivoted to said canister so as to freely swing inwardly only, said flapper door comprising the only communication between said canister and said stored fuel, whereby, said returned fuel is substantially prevented from leaving said canister past said flapper door, but stored fuel from said tank can freely swing said flapper door inwardly to provide make up fuel when the pressure within said canister is less than said tank interior, thereby substantially reducing the heating effect of said returned fuel on said stored fuel.

* * * * *